US007074165B1

(12) United States Patent
Hodge et al.

(10) Patent No.: US 7,074,165 B1
(45) Date of Patent: Jul. 11, 2006

(54) EXERCISE DEVICE

(76) Inventors: Kelvin Hodge, 1995 Wages Way, Jacksonville, FL (US) 32218; Vicklyn Guillaume, 1995 Wages Way, Jacksonville, FL (US) 32218

( * ) Notice: Subject to any disclaimer, the term of this patent is extended or adjusted under 35 U.S.C. 154(b) by 0 days.

(21) Appl. No.: 10/888,751

(22) Filed: Jul. 9, 2004

(51) Int. Cl.
*A63B 26/00* (2006.01)
*A63B 71/00* (2006.01)

(52) U.S. Cl. ..... 482/140; 482/907

(58) Field of Classification Search ..... 562/575; 482/140, 62, 72, 91, 907, 100, 95–96, 23, 482/142, 92–94, 35–40; D21/662, 184, 679
See application file for complete search history.

(56) References Cited

U.S. PATENT DOCUMENTS 4,405,128 A * 9/1983 Mclaughlin et al. ..... 482/97
4,762,363 A * 8/1988 Hart ..... 297/118
5,492,520 A * 2/1996 Brown ..... 482/140
5,545,114 A * 8/1996 Gvoich ..... 482/140
5,577,987 A 11/1996 Brown ..... 482/140
5,696,287 A * 12/1997 Bellis ..... 562/575
5,746,688 A * 5/1998 Prager ..... 482/142
5,772,563 A * 6/1998 Lin ..... 482/140
5,779,607 A * 7/1998 Harris ..... 482/140
5,853,357 A * 12/1998 Jones, Jr. ..... 482/140
5,902,220 A * 5/1999 Lin ..... 482/142
5,931,768 A 8/1999 Amesquita ..... 482/140
6,966,871 B1 * 11/2005 Parmater ..... 482/140
2003/0100415 A1 * 5/2003 Augustine et al. ..... 482/140
2003/0199372 A1 * 10/2003 Robinson et al. ..... 482/140

* cited by examiner

*Primary Examiner*—Lori Amerson
(74) *Attorney, Agent, or Firm*—Goldstein Law Offices, P.C.

(57) ABSTRACT

An exercise device for exercising the abdominal muscles, the back muscles, and the arm muscles of a user. The exercise device comprises a rectangular tubular frame having a seat pad. The frame has a right-angled pull bar assembly pivotally affixed thereunto. The pull bar assembly has a neck/head support pad. In use, the user places the frame of the exercise device upon an existing horizontal support structure, and lies down upon the device, with the buttocks of the user supported upon the seat pad, and the upper torso and head of the user supported upon the neck/head support pad. The user grasps a horizontal crossbar of the pull bar assembly within the hands of the user, and pivots the crossbar downward, thereby causing the neck/head support pad to pivot upward, and thereby elevating the back of the user above the horizontal support structure and making it easier for the user to do a number of sit-up type exercises.

6 Claims, 2 Drawing Sheets

EXERCISE DEVICE

BACKGROUND OF THE INVENTION

1. Field of the Invention

The invention generally relates to an exercise device, and in particular it relates to an exercise device having a pivoting pull bar assembly for making it easier for a user to do sit-up type exercises, and which exercises the abdominal muscles, the back muscles, and the arm muscles of the user.

2. Description of the Related Art

Various physical exercises have been devised for strengthening and toning the muscles of the abdomen and back of an individual. In particular, a "sit-up" is an exercise in which an individual lies flat upon his/her back upon a horizontal support structure, and then raises the back to a sitting position without the use of the hands. While sit-ups are extremely effective for strengthening the abdominal muscles and the back muscles of an individual, they have notable limitations. In particular, sit-ups are a difficult exercise for many individuals, especially for out-of-shape individuals who would most greatly benefit from doing sit-ups. Moreover, sit-ups have virtually no beneficial effects on the arm muscles of the individual. Accordingly, there is a need for an exercise device having a pivoting pull bar assembly that enables use of a user's arms to help raise the back of the user above a horizontal support structure while doing sit-up type exercises, and which thereby exercises the arm muscles as well as the abdominal muscles and the back muscles of the user.

A variety of abdominal exercise devices have been created. For example, U.S. Pat. No. 5,931,768 to Amesquita appears to show an exercise device for the lower back and abdomen, comprised of a rigid back support attached to a grasping element such as a strap. Additionally, U.S. Pat. No. 5,779,607 to Harris appears to show an abdominal exercise device comprised of a frame assembly with a handlebar, and which uses the weight of a user as resistance. Moreover, U.S. Pat. No. 5,545,114 to Gvoich appears to show an exercise device with a rigid upper and lower back support and a set of handles. Furthermore, U.S. Pat. No. 5,577,987 to Brown appears to show an abdominal exercise device comprised of a one-piece frame having a pair of support rails and a cushion.

While these devices may be suitable for the particular purpose employed, or for general use, they would not be as suitable for the purposes of the present invention as disclosed hereafter.

SUMMARY OF THE INVENTION

It is a primary object of the invention to provide an exercise device which makes it easier for a user to engage in sit-up type exercises, and which exercises the arm muscles as well as the abdominal muscles and the back muscles of the user. Accordingly, the exercise device has a pivoting pull bar assembly that enables use of the user's arms to help raise the back of the user above a horizontal support structure while doing sit-up type exercises, and which thereby exercises the arm muscles as well as the abdominal muscles and the back muscles of the user.

Further objects of the invention will become apparent in the detailed description of the invention that follows.

The invention is an exercise device for exercising the abdominal muscles, the back muscles, and the arm muscles of a user. The exercise device comprises a rectangular tubular frame having a seat pad. The frame has a right-angled pull bar assembly pivotally affixed thereunto. The pull bar assembly has a neck/head support pad. In use, the user places the frame of the exercise device upon an existing horizontal support structure, and lies down upon the device, with the buttocks of the user supported upon the seat pad, and the upper torso and head of the user supported upon the neck/head support pad. The user grasps a horizontal crossbar of the pull bar assembly within the hands of the user, and pivots the crossbar downward, thereby causing the neck/head support pad to pivot upward, and thereby elevating the back of the user above the horizontal support structure and making it easier for the user to do a number of sit-up type exercises.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
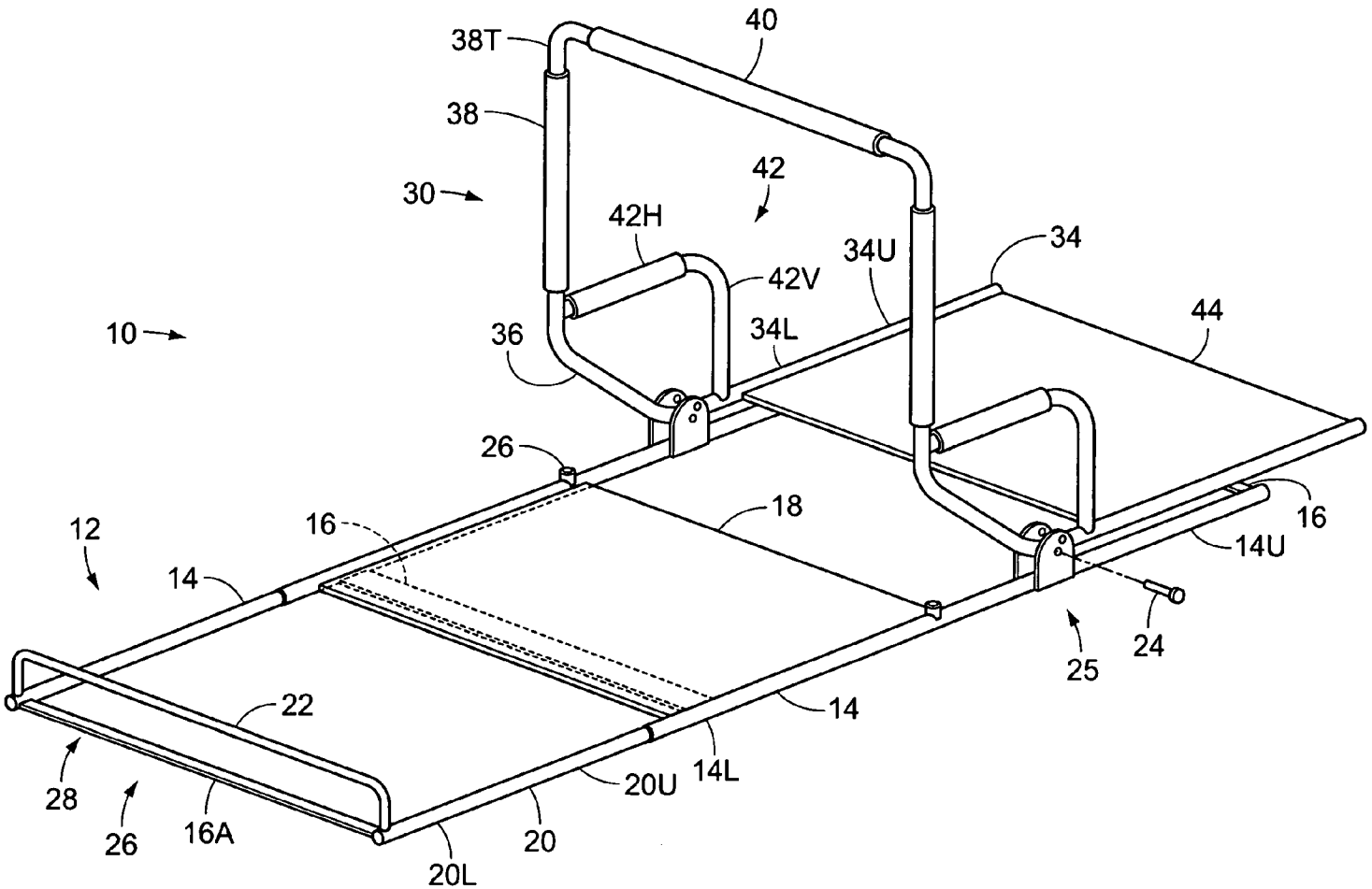
FIG. 1 is a perspective view of an exercise device according to the present invention.
Figure 2:
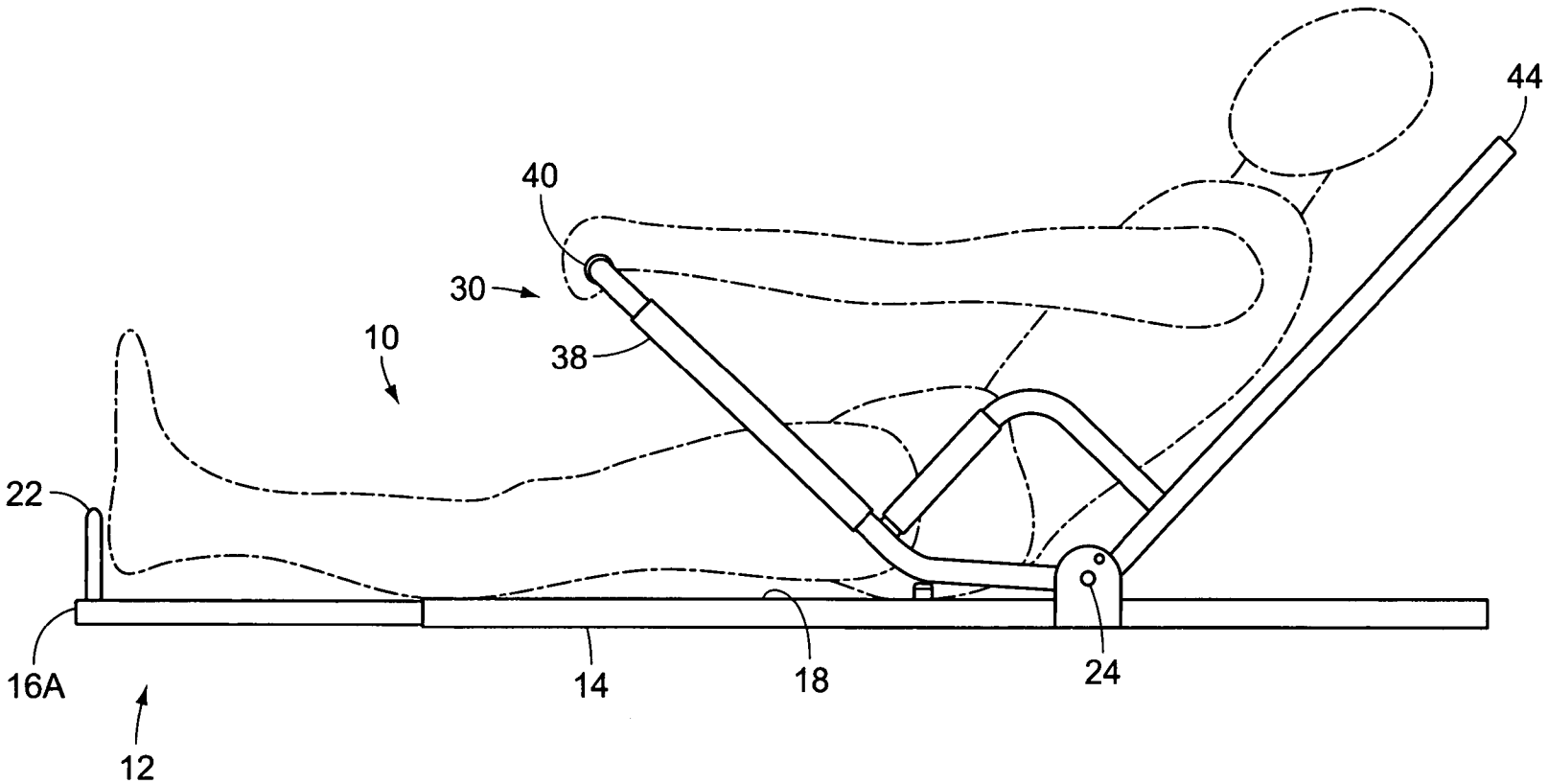
FIG. 2 is a perspective view of the exercise device being utilized by a user to do a sit-up type exercise.

FIG. 1 illustrates an exercise device 10 for exercising the abdominal muscles, the back muscles, and the arm muscles of a user. The exercise device 10 generally comprises a substantially tubular frame 12, and a pull bar assembly 30 pivotally affixed thereunto at two hinges 25 by two hinge pins 24. The frame 12 has a seat pad 18 for supporting the buttocks of the user while the device 10 is being deployed, as will be described. The substantially right-angled pull bar assembly 30 generally comprises a neck/head support pad 44 extending between two spaced neck support rods 34, and a mechanically linked and horizontally situated crossbar 40. The pull bar assembly 30 selectively pivots with respect to the frame 12 upon the hinge pins 24 when a user grasps and exerts downward pressure upon the crossbar 40, as will also be described.

The frame 12 has two spaced longitudinal bars 14, each having an upper portion 14U and a lower portion 14L, and two spaced lateral bars 16, one extending between the upper portions 14U of the longitudinal bars 14, and one extending between the lower portions 14L of the longitudinal bars 14. The substantially rectangular seat pad 18 extends between the lower portions 14L of the longitudinal bars 14.

The neck support rods 34 of the substantially right-angled pull bar assembly 30 each having an upper portion 34U and a lower portion 34L. The lower portion 34L of each of the neck support rods 34 extends into a different diagonal rod 36, each of which in turn extends into a different vertical rod 38 having a top 38T. The crossbar 40 extends between the tops 38T of the two vertical rods 38. The crossbar 40 is covered with rubber or vinyl so that it may be comfortably gripped within the hands of the user.

The pull bar assembly 30 further comprises two L-shaped support members 42, each having a vertical portion 42V which extends into a horizontal portion 42H. The vertical portions 42V extend vertically upward from the lower portions 34L of each of the neck support rods 34 and perpendicularly into the horizontal portions 42H. The horizontal portions 42H are each attached to a different junction between the vertical rods 38 and the diagonal rods 36. The support members 42 confer additional rigidity to the pull bar assembly 30.

The device 10 further comprises a removable bottom section 26 having two spaced extension rods 20, each having an upper portion 20U and a lower portion 20L. A lateral bar 16A extends between the lower portions 20L of the extension rods 20. A toe grip bar 22 also extends between the lower portions 20L of the extension rods 20. The toe grip bar 22 and the lateral bar 16A together define a lateral toe slot 28 for selective insertion therein of the toes of the user to help immobilize the legs of the user while using the device 10. The upper portion 20U of each of the extension rods 20 may be attached to the lower portions 14L of the longitudinal bars 14 by a variety of standard attachment methods, including the use of threaded screws. It is contemplated that the upper portion 20U of each of the extension rods 20 may selectively telescope within the lower portions 14L of the longitudinal bars 14. The upper portion 20U of each of the extension rods 20 may be detached from the lower portions 14L of the longitudinal bars 14 in order to minimize storage space requirements.

Each longitudinal bar 14 has a rubber stop 26 at a location substantially midway between the upper portion 14U and the lower portion 14L of the longitudinal bar 14. The rubber stops 26 selectively contact the pull bar assembly 30 at the junctions between the vertical rods 38 and the diagonal rods 36 when the user pivots the pull bar assembly 30 downward upon the hinge pins 24. The rubber stops 26 selectively cushion the impact of the pull bar assembly 30 upon the tubular frame 12.

The exercise device 10 is preferably constructed from a durable, lightweight metal. The seat pad 18 and the neck/head support pad 44 are preferably constructed from soft foam that is covered with plastic. The dimensions of the exercise device 10 are approximately sixty inches in length and thirty inches in width. It is contemplated that the exercise device 10 will be provided in a variety of sizes so that it may be suitably used by users having different body sizes.

The device 10 makes it easier for the user to do "sit-up" type exercises. The crossbar 40 is mechanically linked to the two neck support rods 34 which border the neck support pad 44. Accordingly, when the user utilizes the muscles of the arm and back to pivot the crossbar 40 downward upon the hinge pins 24, the attached neck support rods 34 swivel upward, thereby helping the user raise his/her back and torso above the horizontal support structure, while still substantially strengthening the arm, back, and abdominal muscles of the user.

In use, a user places the frame 12 of the device 10 upon an existing horizontal support structure such as a floor, and lies down upon the frame 12 with the head and upper torso resting upon the neck/head support pad 44 and the buttocks resting upon the seat pad 18. After lying down upon the frame 12, the user does "sit-up" exercises while holding the crossbar 40 firmly within the hands of the user. In particular, the user utilizes the muscles of the arm and back to pivot the crossbar 40 downward upon the hinge pins 24, thereby causing the attached neck support rods 34 to swivel upward, thereby helping the user to raise his/her back and torso above the horizontal support structure while doing sit-ups, while keeping the legs substantially in contact with the horizontal support structure. Following this, the user ceases to apply downward pressure upon the crossbar, thereby allowing the attached neck support rods 34 to swivel downward, thereby allowing the user to lower his/her back and torso back down to the horizontal support structure. The user repeats the previous two steps until the user has finished exercising.

In conclusion, herein is presented an exercise device having a pivoting pull bar assembly for making it easier for a user to do sit-up type exercises, and which exercises the abdominal muscles, the back muscles, and the arm muscles of the user. The invention is illustrated by example in the drawing figures, and throughout the written description. It should be understood that numerous variations are possible, while adhering to the inventive concept. Such variations are contemplated as being a part of the present invention.

What is claimed is:

1. An exercise device for exercising the abdominal muscles, the back muscles, and the arm muscles of a user while doing sit-up exercises, comprising:

a substantially rectangular tubular frame having two spaced longitudinal bars, each having an upper portion and a lower portion, and two spaced lateral bars, one extending between the upper portions of the longitudinal bars, and one extending between the lower portions of the longitudinal bars, the frame further having a seat pad extending between the lower portions of the longitudinal bars for selectively supporting the buttocks of the user;

an angled pull bar assembly pivotally affixed to the frame at two hinges by two hinge pins, said pull bar assembly having a neck/head support pad extending between two spaced neck support rods, said neck support rods each having an upper portion and a lower portion, wherein the lower portion of each of the neck support rods extends into a different diagonal rod, each of which in turn extends into a different vertical rod having a top, and wherein a crossbar extends between the tops of the two vertical rods; and a removable bottom section having two spaced extension rods, each having a lower portion and an upper portion which attaches to a different one of the lower portions of the longitudinal bars, wherein a lateral bar extends between the lower portions of the extension rods, wherein a toe grip bar also extends between the lower portions of the extension rods, wherein said toe grip bar and lateral bar together define a lateral toe slot for selective insertion therein of the toes of the user to help immobilize the legs of the user while using the device, wherein the upper portion of each of the extension rods may be selectively detached from the lower portions of the longitudinal bars in order to minimize storage space requirements; and wherein when the user grasps the crossbar within the hands of the user and utilizes the muscles of the arm and back to pivot the crossbar downward upon the hinge pins, the attached neck support rods swivel upward, thereby helping the user raise his/her back and torso above the horizontal support structure while doing sit-up type exercises, while still substantially strengthening the arm, back, and abdominal muscles of the user.

2. The exercise device as recited in claim 1, wherein the pull bar assembly is pivotally affixed to the frame at a location substantially midway between the upper portions and the lower portions of the longitudinal bars.

3. The exercise device as recited in claim 2, wherein each longitudinal bar has a rubber stop at a location substantially midway between the upper portion and the lower portion of the longitudinal bar, wherein the rubber stops selectively contact the pull bar assembly at the junctions between the vertical rods and the diagonal rods when the user pivots the pull bar assembly downward upon the hinge pins, said rubber stops for cushioning the impact of the pull bar assembly upon the tubular frame.

4. The exercise device as recited in claim 3, wherein the pull bar assembly further comprises two L-shaped support members, each having a vertical portion which extends into a horizontal portion, wherein said vertical portions extend vertically upward from the lower portions of each of the neck support rods and perpendicularly into the horizontal portions, and wherein the horizontal portions are each attached to a different junction between the vertical rods and the diagonal rods, said support members for conferring additional rigidity to the pull bar assembly.

5. The exercise device as recited in claim 4, wherein the crossbar is covered with a material chosen from a group of materials consisting of rubber and vinyl so that it may be comfortably gripped within the hands of the user.

6. A method for exercising the abdominal muscles, the back muscles, and the arm muscles of a user while doing sit-up exercises upon an existing horizontal support structure, using an exercise device having a frame having two spaced longitudinal bars each having a lower portion, wherein the exercise device further has a removable bottom section having two spaced extension rods, each having a lower portion and an upper portion which attaches to a different one of the lower portions of the longitudinal bars, having a seat pad, having an angled pull bar assembly pivotally affixed thereunto by two hinge pins, said pull bar assembly having a neck/head support pad which is bordered by two neck support rods, and a crossbar which is mechanically linked to the neck support rods, wherein the exercise device further has a lateral bar which extends between the lower portions of the extension rods, wherein a toe grip bar also extends between the lower portions of the extension rods, wherein said toe grip bar and lateral bar together define a lateral toe slot, said method comprising the steps of:

placing the frame of the device upon the horizontal support structure;

lying down upon the frame with the head and upper torso of the user resting upon the neck/head support pad and the buttocks resting upon the seat pad;

inserting the toes of the user into the lateral toe slot;

grasping the crossbar firmly within the hands of the user and utilizing the muscles of the arm and back to pivot the crossbar downward upon the hinge pins, thereby causing the attached neck support rods to swivel upward, thereby helping the user raise his/her back and torso above the horizontal support structure while doing sit-up type of exercises, while still substantially strengthening the arm, back, and abdominal muscles of the user;

ceasing to pivot the crossbar downward upon the hinge pins, thereby allowing the attached neck support rods to swivel downward, thereby allowing the user to lower his/her back and torso back down to the horizontal support structure;

repeating the previous two steps until the user has finished exercising; and detaching the upper portion of each of the extension rods from the lower portions of the longitudinal bars.

* * * * *